US007673625B2

(12) United States Patent
Fienup et al.

(10) Patent No.: US 7,673,625 B2
(45) Date of Patent: Mar. 9, 2010

(54) TOY PROJECTILE LAUNCHING DEVICE

(75) Inventors: William James Fienup, St. Louis, MO (US); Barry Kudrowitz, Delray Beach, FL (US); David Wallace, Lexington, MA (US)

(73) Assignee: Massachusetts Institute of Technology, Cambridge, MA (US)

( * ) Notice: Subject to any disclaimer, the term of this patent is extended or adjusted under 35 U.S.C. 154(b) by 284 days.

(21) Appl. No.: 11/702,234

(22) Filed: Feb. 5, 2007

(65) Prior Publication Data

US 2008/0078366 A1 Apr. 3, 2008

Related U.S. Application Data

(60) Provisional application No. 60/847,837, filed on Sep. 28, 2006.

(51) Int. Cl.
*F41B 7/08* (2006.01)

(52) U.S. Cl. ..... 124/16

(58) Field of Classification Search ..... 124/16, 124/79, 55

See application file for complete search history.

(56) References Cited

U.S. PATENT DOCUMENTS

| | | | | |
|---|---|---|---|---|
| 1,032,501 | A * | 7/1912 | Pierman | 273/138.1 |
| 3,068,851 | A * | 12/1962 | Geer, Jr. | 124/16 |
| 3,356,369 | A * | 12/1967 | Stubbmann | 273/145 CA |
| 3,627,319 | A * | 12/1971 | Van Skyhawk | 124/16 |
| 3,764,142 | A * | 10/1973 | Stubbmann | 273/399 |
| 4,094,294 | A | 6/1978 | Speer | |
| 5,230,324 | A | 7/1993 | Van Horssen et al. | |
| 5,334,079 | A * | 8/1994 | Gentile et al. | 446/486 |
| 6,604,518 | B1 | 8/2003 | Sanford et al. | |
| 7,335,085 | B2 * | 2/2008 | Lyman | 446/486 |

* cited by examiner

*Primary Examiner*—John Ricci
(74) *Attorney, Agent, or Firm*—Wolf, Greenfield & Sacks, P.C.

(57) ABSTRACT

A toy projectile launching device for launching toy projectiles includes a spring shaped as a hollow hemisphere that is capable of being at least partially inverted from a primary normally convex position to a secondary at least partially inverted loaded position. Upon release, the spring snaps back to the primary position, thereby launching the toy projectile.

11 Claims, 7 Drawing Sheets

TOY PROJECTILE LAUNCHING DEVICE

BACKGROUND

1. Field

Aspects of the invention relate to toy projectile technology.

2. Related Art

Various toy projectile launching devices exist whereby the projectile is loaded against the bias of a spring. Upon triggering the toy, the projectile is launched.

SUMMARY

In one illustrative embodiment, a toy device for projecting a toy projectile is provided. The device has a frame and an invertible normally convex resilient elastomeric disc disposed in the frame and having a naturally biased first position and a loaded at least partially inverted second position. The device includes a toy projectile to be projected. A passage into the frame faces the outside surface of the disc with the disc in the naturally biased position enabling the toy projectile to be inserted in the frame against the disc causing the disc to at least partially invert to the loaded position.

In another illustrative embodiment, a method of projecting a toy projectile is provided. The method includes providing a substantially hemispherical like invertible projecting member. The method also includes pressing the toy projectile to be projected against a convex surface of the projecting member causing the projecting member to at least partially invert from a first to a second position so that the surface engaging the toy projectile is concave. The method also includes causing or allowing the member to snap back to the first position and project the toy projectile away from the member.

In another illustrative embodiment, a device for projecting a toy projectile is provided. The device includes a casing having a chamber. A normally convex resilient elastomeric disc is disposed in the chamber. The disc has a normally convex configuration and at least a partially concave configuration. The device has an opening in the casing enabling a toy projectile to be inserted in the chamber against the disc when in the normally convex configuration causing the disc to invert to the at least partially concave configuration position. An actuator is coupled to the chamber and operable to cause or allow the disc to snap from the at least partially concave configuration to the normally convex configuration to project the toy projectile from the opening.

In another illustrative embodiment, a device for projecting a toy projectile is provided. The device includes a bowl-shaped spring symmetrical about a centerline and having a circumference. The spring has a primary biased bowl shape that is at least partially invertible to a secondary shape. A cylindrical barrel is connected to the frame and has a diameter sufficient to accept the toy projectile but smaller than the circumference of the spring. An axis of the barrel coincident with the center line of the spring for guiding the toy projectile to contact the center of the spring when the spring is in its primary shape and forcing the spring to at least partially invert to the secondary shape when the toy projectile is forced further into the barrel against the spring. The device includes an actuator adapted to cause or allow the spring to return to its primary shape and release energy to propel the ball out of the barrel.

In yet another illustrative embodiment, a device for projecting an object is provided. The device includes a barrel with an open end through which the object is to be ejected. The device has a chamber in the barrel. A circular disc shaped spring has a center line substantially coaxial with the barrel and is movable between a primary position wherein the convex side of the spring faces a first end of the barrel and at least a partially inverted position wherein a convex surface of the disc faces a second opposite end of the barrel. The spring is at least partially invertible in the chamber from the primary position to the inverted position when the object to be projected is inserted in the first end of the barrel.

Various embodiments of the present invention provide certain advantages. Not all embodiments of the invention share the same advantages and those that do may not share them under all circumstances.

Further features and advantages of the present invention, as well as the structure of various embodiments of the present invention are described in detail below with reference to the accompanying drawings.

BRIEF DESCRIPTION OF DRAWINGS

The accompanying drawings are not intended to be drawn to scale. In the drawings, each identical or nearly identical component that is illustrated in various figures is represented by a like numeral. For purposes of clarity, not every component may be labeled in every drawing. In the drawings.

DETAILED DESCRIPTION

Figure 1:
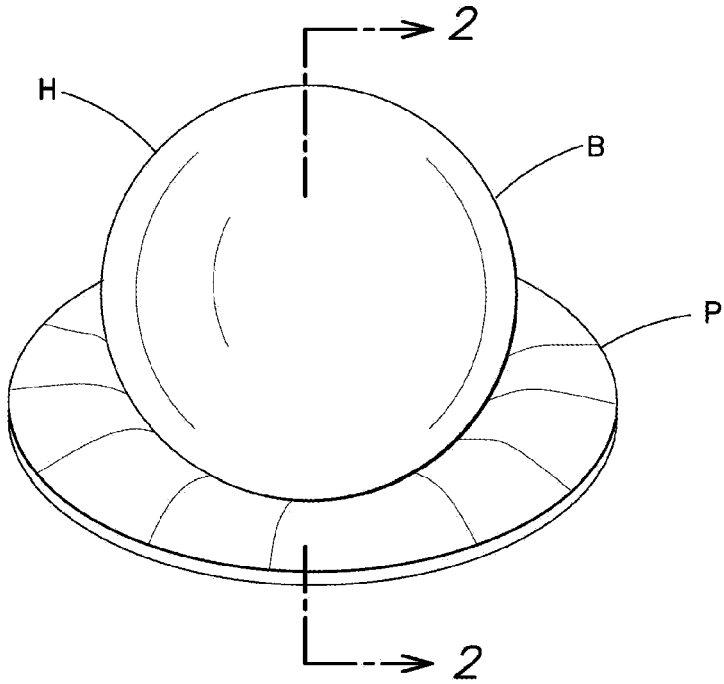
FIG. 1 is a perspective view of a projectile shaped as a ball resting on a launcher in the form of a bi-stable rubber spring with the spring in the loaded or cocked inverted position.

This invention is not limited in its application to the details of construction and the arrangement of components set forth in the following description or illustrated in the drawings. The invention is capable of other embodiments and of being practiced or of being carried out in various ways. Also, the phraseology and terminology used herein is for the purpose of description and should not be regarded as limiting. The use of "including," "comprising," or "having," "containing,"

"involving," and variations thereof herein, is meant to encompass the items listed thereafter and equivalents thereof as well as additional items.

A hand-held toy projectile launching device that is inexpensive to manufacture and easy to use is provided. The launcher includes a spring that may be energized so as to launch the projectile when the spring energy is released. In one embodiment, the spring is formed as a bi-stable element. In one embodiment of the bi-stable spring, the energy in the spring when the projectile is in the loaded position is less than the energy stored in the spring when the spring launches the projectile. Further, the force required to store the energy in the spring is minimized. The force required to load the spring is within the ability of young teenagers. In one embodiment, that force is on the order of less than or about 20 lbs., and in another embodiment, about 18.5 lbs.

In one embodiment, the spring is formed as a hemispherically shaped hollow dome similar to half of a tennis ball or half of a handball, although other suitable shapes may be employed, as the present invention is not limited in this regard. The material employed for the spring may be any suitable material capable of continuously moving between a partially or fully inverted inside-out position to a deployed position over the useful life of the toy. In one embodiment, the spring is formed of rubber. In one embodiment, the rubber has a low durometer. In one embodiment, the spring is formed of an elastomeric material.

In one embodiment, the toy fits within the palm of the hand, is hand-operated and is designed to project a projectile vertically approximately sixteen feet and horizontally a distance of approximately thirty feet when launched at approximately a 45° angle. In one embodiment, the toy is capable of discharging projectiles one at a time or several simultaneously.

The projectiles may be in the form of a soft foam or sponge-like ball, although other suitable shapes and/or materials for the projectiles may be employed, as the present invention is not limited in this regard. In one embodiment, the toy projectile is a toy dart. In one embodiment, the toy projectile may be a combination of shapes.

The launching device may be shaped in any desired configuration, as the present invention is not limited in this regard. In one embodiment, the toy includes a hand grip and/or a trigger to launch the projectile, with the projectile being situated within a barrel. In another embodiment, the toy fits within a palm of the user and includes a depressible button to launch the projectile from a barrel.

Figure 1A:
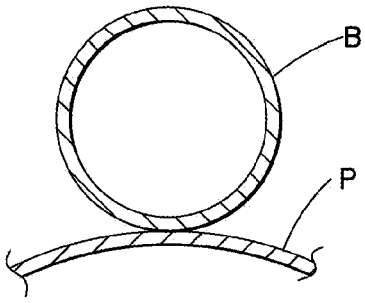
FIG. 1A is a cross-sectional view of the ball and launcher showing their physical relationship before the spring is inverted to its loaded position.
Figure 2:
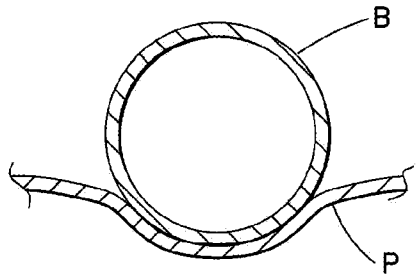
FIG. 2 is a cross-sectional view taken along section line 2-2 of FIG. 1.
Figure 3:
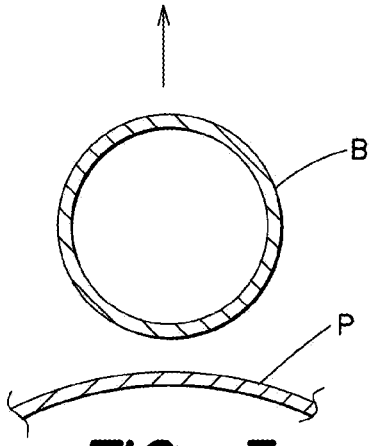
FIG. 3 is a view similar to FIG. 3 but showing the spring immediately after snapping to its primary, stable position with the ball propelled away from the spring.

In FIGS. 1-3, one embodiment of the launching device and projectile is shown diagrammatically and the drawings illustrate the basic operation of the launching device. The projectile shown is a soft rubber ball B, although other materials and shapes may be used as the present invention is not limited in this regard. In one embodiment, the projecting mechanism P is a dish-shaped spring that may be a segment of a hollow sphere. In FIG. 1A the spring is shown in its unloaded position with the ball in position to apply a load against it to move the spring to the loaded position. In FIGS. 1 and 2, the projecting mechanism P is shown in its inverted or loaded condition and the ball B is resting on it with their axes aligned with one another. The two spring positions are shown in FIGS. 1A and 2, FIG. 2 showing the loaded secondary position and FIG. 1A the unloaded primary position. As the spring P inverts from the position shown in FIGS. 1 and 2 to the position shown in FIG. 3, the snapping action of the spring propels the ball B with a force which is a function of the nature of the spring material and geometry.

In one embodiment, the device is configured such that the spring moves between two bi-stable positions, namely a normally convex position and a fully inverted position. Upon actuation of a trigger, the spring is urged from the second stable position toward the first stable position. Once this movement is initiated, the spring can move completely to the normally convex position to propel the toy projectile. It should be appreciated that the present invention is not limited in this regard, as the second bi-stable position may be a partially inverted position. Further, in other embodiments, the device need not employ a bi-stable spring at all. Rather the second partially inverted position may be an unstable position, such that upon release of a holding mechanism that holds the spring in the second position or holds the toy projectile against the bias of the spring, the spring immediately snaps back to a normally convex position. Although a single piece dome-like spring is shown and described, other suitable spring arrangements may be employed, as the present invention is not limited in this regard.

Figure 4:
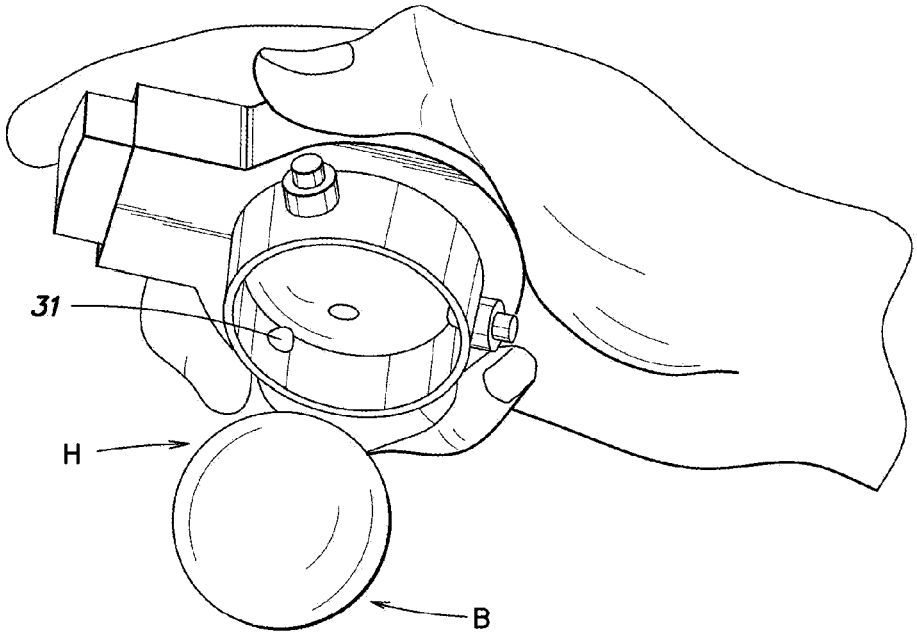
FIG. 4 is a pictorial illustration showing a hand held embodiment of the invention employing the ejecting mechanism of FIGS. 1-3.
Figures 5, 5A:
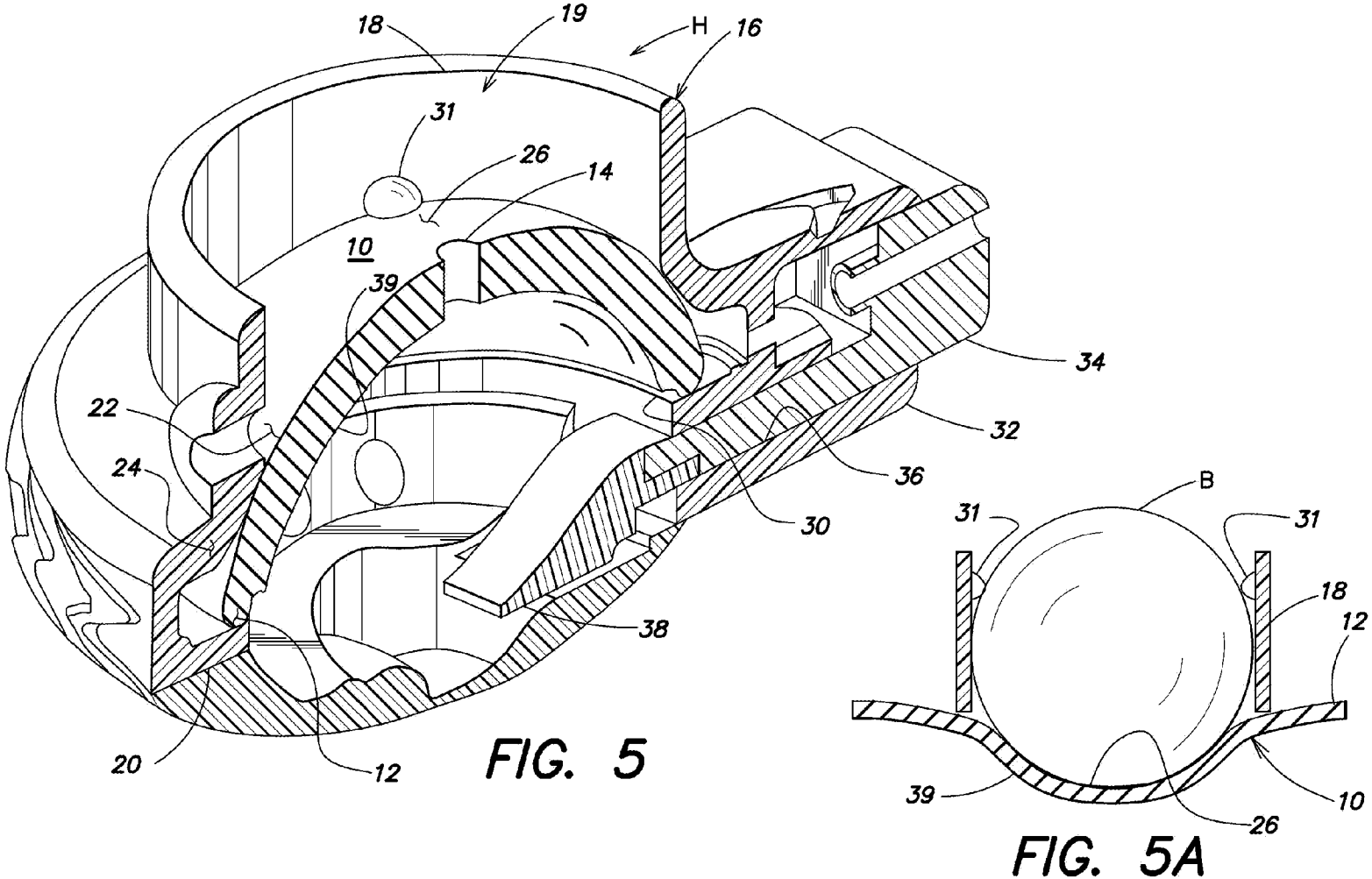
FIG. 5 is a perspective cross-sectional view of the embodiment shown in FIG. 4.
FIG. 5A is a diagrammatic view of a portion of the hand held embodiment of the invention shown in FIGS. 4 and 5.

The concepts described above and shown in FIGS. 1-3 may be embodied in a hand-held toy H shown in FIGS. 4 and 5. The toy H is sized to fit into the palm of the hand and can be operated by one or more fingers. In FIG. 4 the ball B is shown immediately after leaving the barrel of the toy. In FIG. 5 the projecting mechanism includes a spring 10 that is shaped as a segment of a sphere having a circular edge 12 and a hole 14 at its center. The spring 10 is supported in a frame 16 having a discharge barrel 18 that is axially aligned with the spring 10. The peripheral edge 12 of the spring rests on flange 20 of the frame 16, and the surface 22 of the spring inwardly of the edge 12 engages or is in close proximity to the frame shoulder 24 at the inner end of the barrel 18. The diameter of the barrel is smaller than the diameter of the spring measured to its edge 12 and therefore, the spring will not fall out of the frame regardless of the frame's orientation. Other suitable arrangement for securing the spring may be employed, as the present invention is not limited in this regard.

The spring 10 is shown in FIG. 5 in its primary position wherein the spring surface 26 facing the open end 19 of the barrel 18 is convex. The spring however, may be inverted, fully or partially, to its loaded or projecting position so that at least a portion of surface 26 is concave and extends inwardly beyond the opening 30 defined by the inner circular edge of the flange 20 of the frame. The edge 12 of the spring remains captured between the flange 20 and shoulder 24. The spring 10 is loaded so as to store energy by inverting it from its primary position shown in FIG. 5 to the secondary, loaded, position shown in FIGS. 1 and 2.

When a toy projectile, such as a ball, is to be projected, it is introduced to the device by inserting it into the discharge barrel 18 through end 19 so that it engages the surface 26 of the spring 10 that is in the primary stable position. By forcing the toy projectile further into the barrel 18 against the spring 10, the spring is at least partially inverted by the toy projectile and the two remain in that position until the toy projectile is discharged. In one embodiment, the toy projectile B is held in the barrel in position immediately adjacent the spring 10 by the projections 31 spaced about the inside of the barrel 18 and that engage the surface of the toy projectile as shown in FIG. 5A. The effective diameter of the barrel described by projections 31 preferably is slightly smaller than the periphery of the toy projectile.

In accordance with another embodiment of the invention, the projections may comprise a non-slippery surface that will resist the toy projectile from sliding out of the barrel unless a substantial force, e.g., the inversion of the spring, exerted on the toy projectile overcomes the resistance of the projections and drives the toy projectile over the projections and expels it out the end 19 of the barrel. Other suitable arrangements for holding the toy projectile may be employed, as the present invention is not limited in this regard. For example, the projection 31 may be retractable via an actuator whereby when in the deployed position, the toy projectile is held against the bias of the spring and when retracted, the toy projectile can be propelled by the spring. In another embodiment, a retractable latch may be employed which is constructed to hold the spring itself in its loaded (e.g. fully inverted or partially inverted) position. Upon actuation of the latch, whereby at least a portion of the latch is retracted, the spring can snap back to its normally convex position to propel the toy projectile. Thus, the toy projectile is discharged by causing or otherwise allowing the spring to move from the secondary position shown in FIG. 5A, to the primary position and release its energy causing the toy projectile to fly out of the barrel.

In one embodiment, the frame 16 of the toy includes an extension 32 which serves as both a handle for the unit and a guide for the triggering or releasing mechanism 34. In one embodiment employing a triggering mechanism, the mechanism 34 is slidably mounted in a slot 36 in the handle enabling the mechanism to move between the retracted position shown in FIG. 5 and an extended position wherein the head 38 of the trigger mechanism engages and pushes against the lower surface 39 of the spring so as to initiate the snapping movement of the spring transferring from the secondary stable position of FIG. 5A to its primary stable position, which causes the spring to eject the toy projectile through the barrel 18. During the inverting action of the spring, its edge 12 is free to move in the recess defined between the flange 20 and the shoulder 24 and ultimately assume the position shown in FIG. 5.

It has been found that an unconstrained edge provides for a lower loading force than an arrangement where the spring edge 12 is constrained. Accordingly, in one embodiment, the recess described above formed between flange 20 and shoulder 24 is sufficiently sized so that the edge 12 of the spring can expand radially outward into the recess in an unconstrained manner. This freedom allows the spring to invert more readily, thereby decreasing the inversion force that would otherwise occur if the edges 12 were more constrained.

To reduce the inversion force still further, the area surrounding the edge 12, that is the surfaces of either flange 20 or shoulder 24 or both may be formed with a reduced friction surface. In one embodiment, one or both surfaces may include lubrication for example in the form of a dry powder lubricant or a coating, such as Teflon. Alternatively, one or both surfaces themselves may be formed from a low-friction material such as Teflon. Other suitable friction reducing arrangements, such as the use of ball bearings, may be employed, as the present invention is not limited in this regard.

Figure 6:
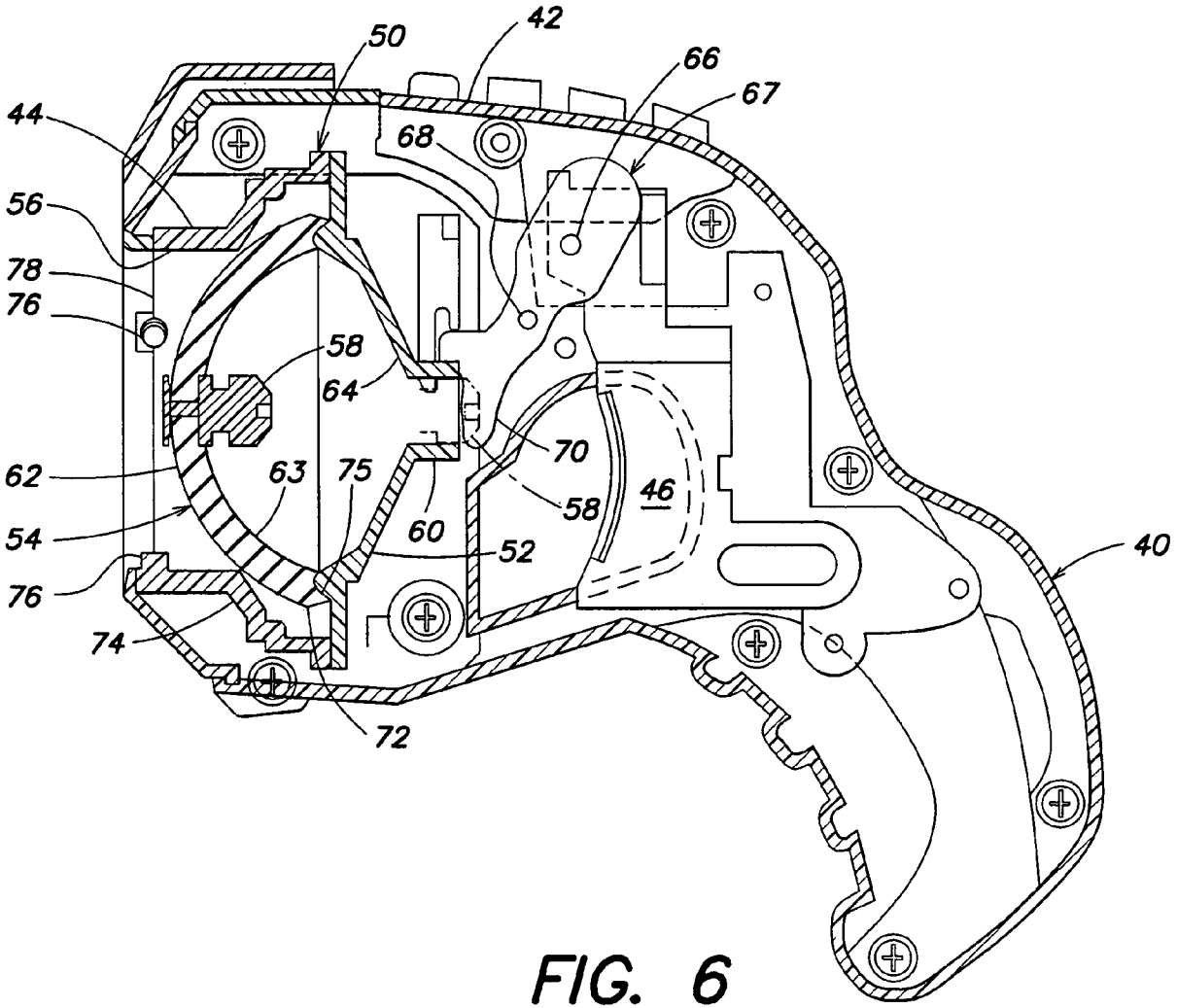
FIG. 6 is a cross-sectional view of another embodiment of the invention employing the bi-stable spring arrangement shown in FIGS. 1-3.
Figure 7:
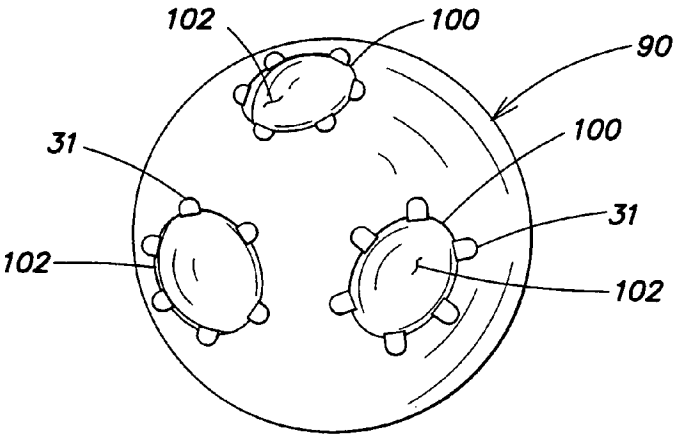
FIG. 7 is a pictorial illustration of another embodiment of the invention embodying the bi-stable spring arrangement of FIGS. 1-3.

In FIG. 6 the projecting mechanism described above is shown incorporated into a device that has a hand grip 40, muzzle 42 and trigger 46. The muzzle 42 houses a frame 50 and brace 52 that together capture the rubber spring 54. The frame also includes the barrel 44 through which the ball to be projected is introduced into the toy and through which it is ejected by the spring. In this embodiment, the spring 54 carries a fixture 58 at its center and which extends into a sleeve 60 in the brace 52 when the spring is inverted to the secondary or loaded position. This is suggested in phantom in FIG. 6 wherein the fixture 58 is partially shown in the sleeve 60 of brace 52. In full lines, the spring 54 is shown in its primary position and when the toy projectile is inserted into the barrel 44 via the open end 56, the toy projectile engages the convex surface 62 of the spring 54 and with sufficient pressure, the spring inverts and its rear surface 63 lies in close proximity to the surface 64 of the brace 52, and the fitting 58 enters the sleeve 60. In one embodiment employing a bistable spring, the spring 54 will remain in that position until pressure is applied against the surface 63 urging the spring to invert and snap back to the full line position of FIG. 6. That action ejects the toy projectile from the barrel 44 through port 56.

It has been found that off-center loading of the projectile against the spring to cause it to at least partially invert to the secondary loaded position may increase the insertion force as compared to when the projectile is loaded with the axis of the projectile and spring aligned with one another. To foster such loading, in one embodiment, the barrel acts as a guide to position the toy projectile so that inversion may occur whereby the force is applied as axially as possible. Other suitable alignment arrangements may be employed, as the present invention is not limited in this regard.

In the embodiment shown in FIG. 6, the trigger 46 is shown pivotally connected at pivot 66 to an actuator 67 that in turn is pivotally mounted intermediate its ends on fixed pivot 68. The lower end 70 of the actuator engages the fixture 58 carried on the spring and when the trigger 46 is squeezed, the actuator 67 pushes the fixture 58 and the spring with it over center, causing the spring to snap back to the primary position of FIG. 6 and eject the toy projectile loaded in the barrel. Other suitable trigger arrangements may be employed, as the present invention is not limited in this regard. Indeed, as described above, a latch mechanism holding the spring in position and allowing the spring to return to the normally convex position, may be employed.

In one embodiment, as in the first described embodiment of FIGS. 4 and 5, the peripheral edge 72 of the spring moves toward the shoulder 74 of the frame 50 when the spring is loaded and rests on the surface 75 of the brace when the spring is in the primary position.

To stabilize the system when the toy projectile is inserted into the port 56, several retainers 76 (three are suggested in FIG. 6) are equidistantly spaced adjacent the outer edge 78 of the port 56 to hold the toy projectile in the barrel 44, but that resistive force is easily overcome by the energy of the spring as it snaps from the secondary or loaded position to the primary position, thereby enabling the toy projectile to be projected a substantial distance under the force generated by the spring. Other suitable retaining arrangements may be employed, including those described above, as the present invention is not limited in this regard.

Figure 8A:
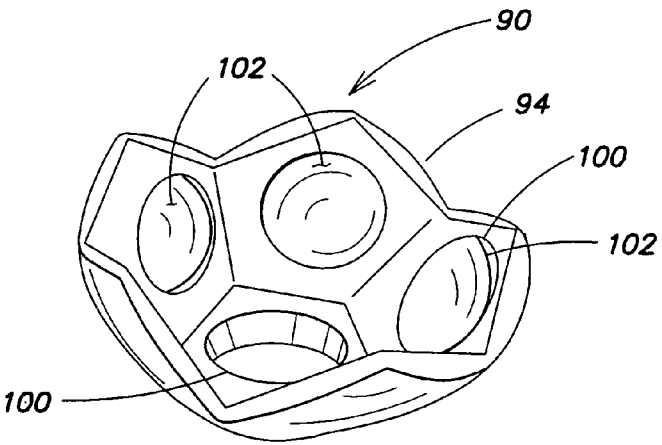
FIGS. 8 and 8A are perspective views of two segments of the spherical body shown in FIG. 7.
Figure 8:
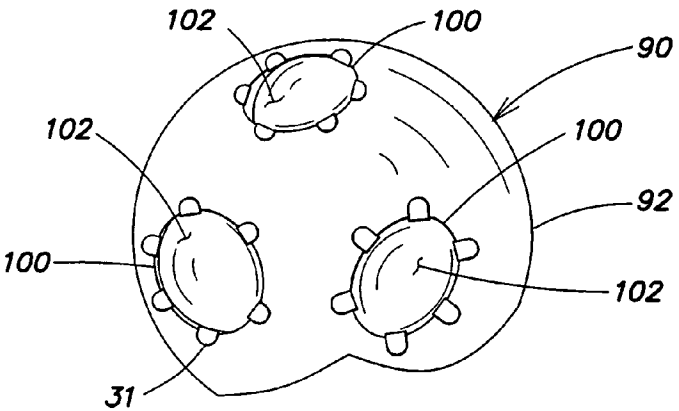

In the embodiment of FIGS. 7-10, a projectile launching device capable of simultaneously or sequentially launching a number of projectiles is shown. This embodiment of the invention has a spherical housing 90, made of two segments 92 and 94 shown separately in FIGS. 8 and 8A. The sphere has a number of openings 100, each of which contains a projecting device and projectile holder that function in a manner similar to that described with reference to FIGS. 1-3. In this embodiment, each opening 100 contains a normally convex spring 102 supported about its periphery by a frame (not shown) that enables the spring to at least partially invert in the same fashion as described in connection with FIGS. 1 and 3 as well as in the previously described embodiments. In one embodiment, about the periphery of each opening 100 are a plurality of projections 31 like those in FIGS. 5 and 5A that are sized to capture the toy projectile so as to retain it in place when it is inserted against the spring causing the spring to at least partially invert to the loaded condition.

Figure 9:
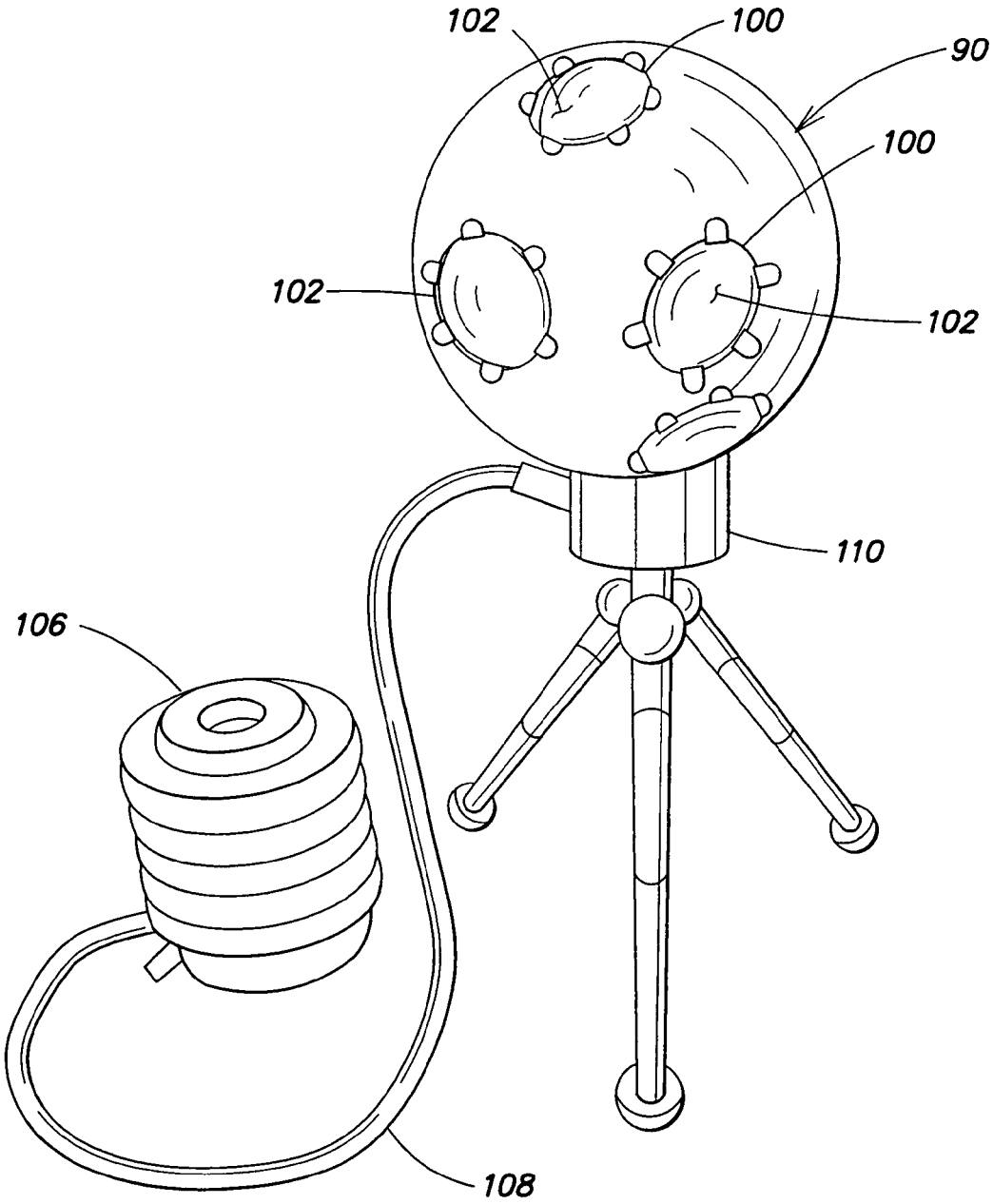
FIG. 9 is a pictorial illustration of the embodiment of the invention shown in FIGS. 7 and 8 with one form of triggering mechanism.
Figure 10:
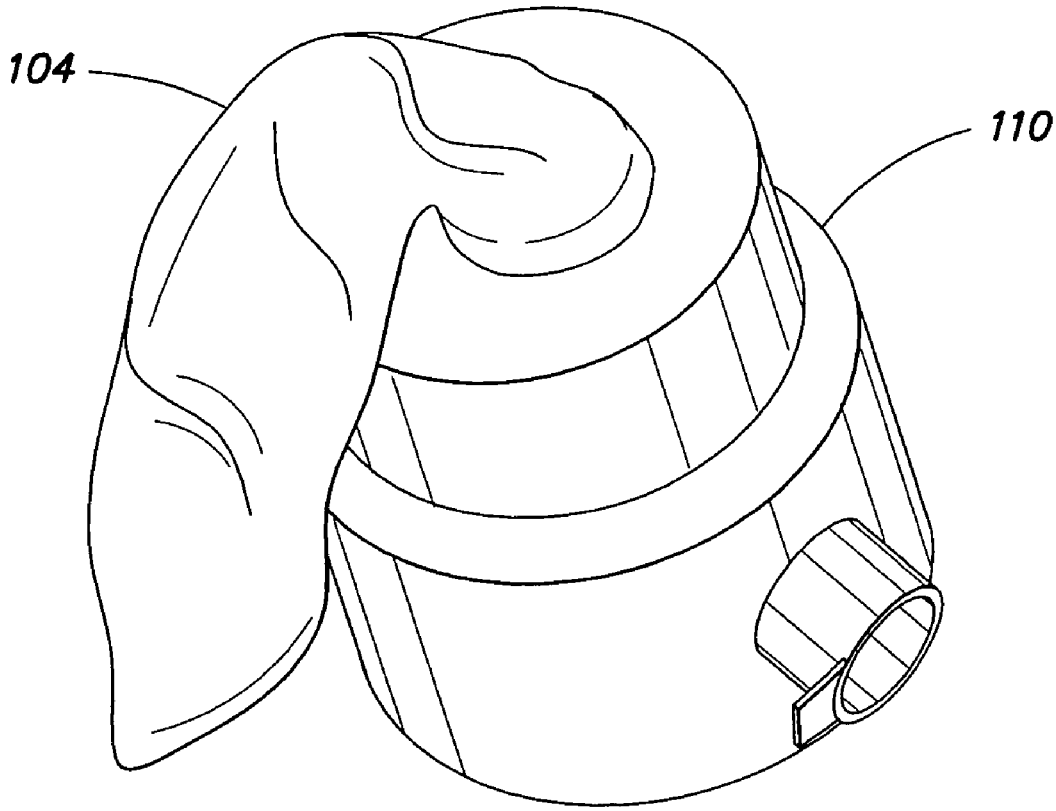
FIG. 10 is a pictorial illustration of details of the triggering mechanism of FIG. 9.

A number of different triggering devices may be incorporated into the device so as to cause or allow the springs to snap back to the primary position and eject the toy projectiles engaging it, as the present invention is not limited in this regard. One other such arrangement is shown in FIGS. 9 and 10. In this embodiment, an internal bladder 104 may be provided in the housing 90 and connected to a pump 106 by means of hose 108 and fitting 110. When the bladder 104 is expanded, it will exert an initiating force against each spring 102 causing it to snap to the normally convex position and expel the toy projectile it engages. That action may be designed to eject all the toy projectiles simultaneously, randomly, and/or in sequence. As one alternative, a timing mechanism and mechanical trigger may be incorporated into the spherical housing to initiate inversion of the springs to discharge all of the projectiles. In this regard, a spring loaded timer turns an internal plate. When the timer reaches a certain location, the plate spins and separates two triggering hemispheres or linkages, thus activating all springs simultaneously.

Although these alternative triggering arrangements are described with reference to the multiple launch embodiment of FIGS. 9 and 10, it should be appreciated that the present invention is not limited in this regard, as any of these triggering arrangements may be employed in any of the toy embodiments described herein as well as any other toy embodiment. Further, it has been found that triggering location might play a role in more reliable launching, including distances achieved. In particular, in one embodiment, the trigger acts on a central location, or apex, of the spring, rather than on the side of the spring. Of course, other suitable locations may be employed, including at the side, as the present invention is not limited in this regard.

It should be appreciated that the toy projectile launching device may be used in a game and may be played alone or with multiple players and/or multiple toys. As such, the present invention is not limited to any particular use, as any suitable game may be played using the toy projectile launching device.

Having thus described several aspects of several embodiments of this invention, it is to be appreciated various alterations, modifications, and improvements will readily occur to those skilled in the art. Such alterations, modifications, and improvements are intended to be part of this disclosure, and are intended to be within the spirit and scope of the invention. Accordingly, the foregoing description and drawings are by way of example only.

What is claimed is:

1. A toy device for projecting a toy projectile comprising:
a frame;
an invertible, normally convex resilient elastomeric disc disposed in the frame and having a naturally biased first position and a loaded at least partially inverted second position;
a passage into the frame facing the convex surface of the disc with the disc in the naturally biased position enabling a toy projectile to be inserted in the frame against the disc causing the disc to at least partially invert to the loaded position; and
a latch coupled to the frame and adapted to hold the disc in the at least partially inverted position, the latch operable to release the disc so that the disc snaps from the second position and projects the toy projectile from the frame.

2. The device of claim 1, further comprising an actuator coupled to the frame and operable on the disc to urge the disc to snap from the second position to the first position and project the toy projectile from the frame.

3. The device of claim 1 wherein the disc is approximately hemispherically shaped and the toy projectile engages the convex side of the disc and at least partially inverts the disc so that the toy projectile is disposed against a concave surface of the disc.

4. The device of claim 1 wherein the disc is retained in the frame at an edge of the disc.

5. A toy device for projecting a toy projectile comprising:
a frame;
an invertible, normally convex resilient elastomeric disc disposed in the frame and having a naturally biased first position and a loaded at least partially inverted second position;
a passage into the frame facing the convex surface of the disc with the disc in the naturally biased position enabling a toy projectile to be inserted in the frame against the disc causing the disc to at least partially invert to the loaded position; and
a latch coupled to the frame and adapted to hold the toy projectile against the bias of the disc, the latch operable to release the toy projectile so that the disc snaps from the second position and projects the toy projectile from the frame.

6. A device for projecting a toy projectile comprising:
a casing having a chamber therein;
a normally convex resilient elastomeric disc disposed in the chamber, the disc having a normally convex configuration and at least a partially concave configuration;
an opening in the casing enabling a toy projectile to be inserted in the chamber against the disc when in the normally convex configuration causing the disc to invert to the at least partially concave configuration position;
an actuator coupled to the chamber and operable to cause or allow the disc to snap from the at least partially concave configuration to the normally convex configuration to project the toy projectile from the opening; and
a means for releasably retaining the toy projectile against the disc when the disc is in the at least partially concave configuration.

7. A device for projecting a toy projectile comprising:
a bowl-shaped spring symmetrical about a centerline and having a circumference, said spring having a primary biased bowl shape and being at least partially invertible to a secondary shape,
a frame supporting the circular edge of the spring and enabling the spring to move between the primary shape and the secondary shape,
a cylindrical barrel connected to the frame and having a diameter sufficient to accept a toy projectile but smaller than the circumference of the spring and with an axis of the barrel coincident with the center line of the spring for guiding the toy projectile to contact the center of the spring when the spring is in its primary shape and forcing the spring to at least partially invert to the secondary shape when the toy projectile is forced further into the barrel against the spring, and
an actuator adapted to cause or allow the spring to return to the primary shape and release energy to propel the toy projectile out of the barrel.

8. A device for projecting an object comprising:
a body including a barrel with an open end through which the object is to be ejected;
a chamber in the barrel; and
a circular disc shaped spring having a center line substantially coaxial with the barrel and movable between a primary position wherein a convex side of the spring faces a first end of the barrel and at least a partially inverted position wherein a convex surface of the disc faces a second opposite end of the barrel;

said spring being at least partially invertible in the chamber from the primary position to the inverted position when the object to be projected is inserted in the first end of the barrel; and a release mechanism constructed and arranged to hold the spring in the at least partially inverted position and, the release mechanism operable to release the spring to snap from the at least partially inverted position to primary position to project the object from the barrel.

9. The device of claim 8 wherein the spring is bi-stable and will remain in the at least partially inverted position until triggered to urge and invert the spring back to the primary position.

10. The device of claim 8, wherein the body includes a hand grip.

11. A device for projecting an object comprising:

a body including a barrel with an open end through which the object is to be ejected;

a chamber in the barrel; and a circular disc shaped spring having a center line substantially coaxial with the barrel and movable between a primary position wherein a convex side of the spring faces a first end of the barrel and at least a partially inverted position wherein a convex surface of the disc faces a second opposite end of the barrel;

said spring being at least partially invertible in the chamber from the primary position to the inverted position when the object to be projected is inserted in the first end of the barrel; and a release mechanism constructed and arranged to hold the object against the bias of the spring when in the at least partially inverted position, the release mechanism operable to release the object so that the spring snaps from the at least partially inverted position and projects the object from the barrel.

* * * * *